US008223985B2

(12) United States Patent
Loud

(10) Patent No.: US 8,223,985 B2
(45) Date of Patent: Jul. 17, 2012

(54) MASKING OF PURE TONES WITHIN SOUND FROM A NOISE GENERATING SOURCE

(75) Inventor: Richard Lynn Loud, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 543 days.

(21) Appl. No.: 12/428,071

(22) Filed: Apr. 22, 2009

(65) Prior Publication Data

US 2010/0272285 A1 Oct. 28, 2010

(51) Int. Cl.
*H04R 3/02* (2006.01)

(52) U.S. Cl. ..... 381/73.1; 381/71.4; 381/94.1

(58) Field of Classification Search ..... 381/73.1, 381/71.4, 71.5, 71.14, 94.1, 94.2, 94.3; 704/226
See application file for complete search history.

(56) References Cited

U.S. PATENT DOCUMENTS

| | | | |
|---|---|---|---|
| 3,732,371 | A | 5/1973 | Burwen |
| 3,879,578 | A | 4/1975 | Wildi |
| 3,985,957 | A | 10/1976 | Torn |
| 4,024,535 | A | 5/1977 | Goldstein |
| 4,185,167 | A | 1/1980 | Cunningham et al. |
| 4,319,088 | A | 3/1982 | Orfield |
| 4,438,526 | A | 3/1984 | Thomalla |
| 4,450,321 | A | 5/1984 | Quigley et al. |
| 4,686,693 | A | 8/1987 | Ritter |
| 4,761,921 | A | 8/1988 | Nelson |
| 4,862,863 | A | 9/1989 | Komurasaki |
| 4,914,706 | A | 4/1990 | Krause |
| 5,040,217 | A | 8/1991 | Brandenburg et al. |
| 5,192,342 | A | 3/1993 | Baron et al. |
| 5,360,469 | A | 11/1994 | Baron et al. |
| 5,682,463 | A | 10/1997 | Allen et al. |
| 5,699,479 | A | 12/1997 | Allen et al. |
| 5,784,670 | A | 7/1998 | Sasahara et al. |
| 5,867,748 | A | 2/1999 | Takahashi et al. |
| 5,930,557 | A | 7/1999 | Sasahara et al. |
| RE36,714 | E | 5/2000 | Brandenburg et al. |
| 6,188,771 | B1 | 2/2001 | Horrall |
| 6,290,140 | B1 | 9/2001 | Pesko et al. |
| 6,823,176 | B2 | 11/2004 | Rogers |
| 6,888,945 | B2 | 5/2005 | Horrall |
| 6,950,526 | B2 | 9/2005 | Garstick |
| 7,024,871 | B2 | 4/2006 | Zhu et al. |
| 7,110,941 | B2 | 9/2006 | Li |
| 7,163,263 | B1 | 1/2007 | Kurrasch et al. |
| 7,194,094 | B2 | 3/2007 | Horrall et al. |
| 7,299,798 | B2 | 11/2007 | Flanagan |
| 7,349,547 | B1 | 3/2008 | Isvan |
| RE40,280 | E | 4/2008 | Johnston |
| 2006/0009969 | A1 | 1/2006 | L'Esperance et al. |

FOREIGN PATENT DOCUMENTS

| | | | |
|---|---|---|---|
| DE | 102004031657 | A1 | 2/2006 |
| DE | 102007030250 | A1 | 1/2009 |

OTHER PUBLICATIONS

EP10160407, European Search Report and Written Opinion, Sep. 10, 2010.

*Primary Examiner* — Kevin M Picardat
(74) *Attorney, Agent, or Firm* — Cantor Colburn LLP

(57) ABSTRACT

A method and system for masking pure tones within sound generated from a noise generating source. The method includes detecting one or more pure tones within sound being generated from the noise generating source, and generating one or more masking sounds capable of masking only the one or more pure tones detected within the sound.

10 Claims, 7 Drawing Sheets

MASKING OF PURE TONES WITHIN SOUND FROM A NOISE GENERATING SOURCE

BACKGROUND OF THE INVENTION

The subject matter disclosed herein relates to masking pure tones within sound being generated from a noise generating source by reducing the intensity of pure tones within the sound.

Today, noise generating sources may create unwanted, distracting noise in various environments. For example, some noise generating sources may include printing devices, heating and ventilating (HVAC) equipment, gas turbines, and automobiles. The unwanted noise may therefore exist in office environments, inside and outside power plants, or in open-air environments, for example. The unwanted noise may include broad band noise (e.g., white noise) or tonal noise (i.e., pure tones) or a combination of both. A pure tone may be recognized in the form of a whistling sound or a siren type sound. There are typical methods used to reduce unwanted noise produced from the noise generating sources.

In a power plant environment, certain environmental noise standards must be met. One method for reducing the tonal noise from power plant equipment or the power plant as a whole, or other noise generating sources has been to reduce the intensity of the pure tones by using a silencer. The task of reducing the intensity of pure tone may become very difficult and expensive.

BRIEF DESCRIPTION OF THE INVENTION

According to one aspect of the invention, a method for masking pure tones within sound being generated from a noise generating source is provided. The method includes detecting one or more pure tones within sound being generated from the noise generating source, and generating one or more masking sounds capable of masking the one or more pure tones detected within the sound.

According to another aspect of the invention, a sound masking system for masking pure tones within sound being generated from a noise generating source is provided. The system includes a signal generation device which receives a selected masking spectrum when one or more pure tones are detected, and generates one or more masking sounds at a volume corresponding to the selected masking spectrum, at least one amplifier which amplifies the one or more masking sounds, and at least one speaker operatively connected with the at least one amplifier, which outputs the one or more masking sounds to mask the one or more pure tones detected.

According to yet another aspect of the invention, a sound masking system for masking pure tones within sound being generated from a noise generating source is provided. The system includes at least one sensing device which senses the sound being generated from the noise generating source; at least one signal generation device which receives feedback from the at least one sensing device, detects one or more pure tones within the sound being generated from the noise generating source and generates one or more masking sounds capable of masking the one or more pure tones detected; at least one amplifier which amplifies the one or more masking sounds; and at least one speaker operatively connected with the at least one amplifier, which outputs the one or more masking sounds to mask the one or more pure tones detected.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
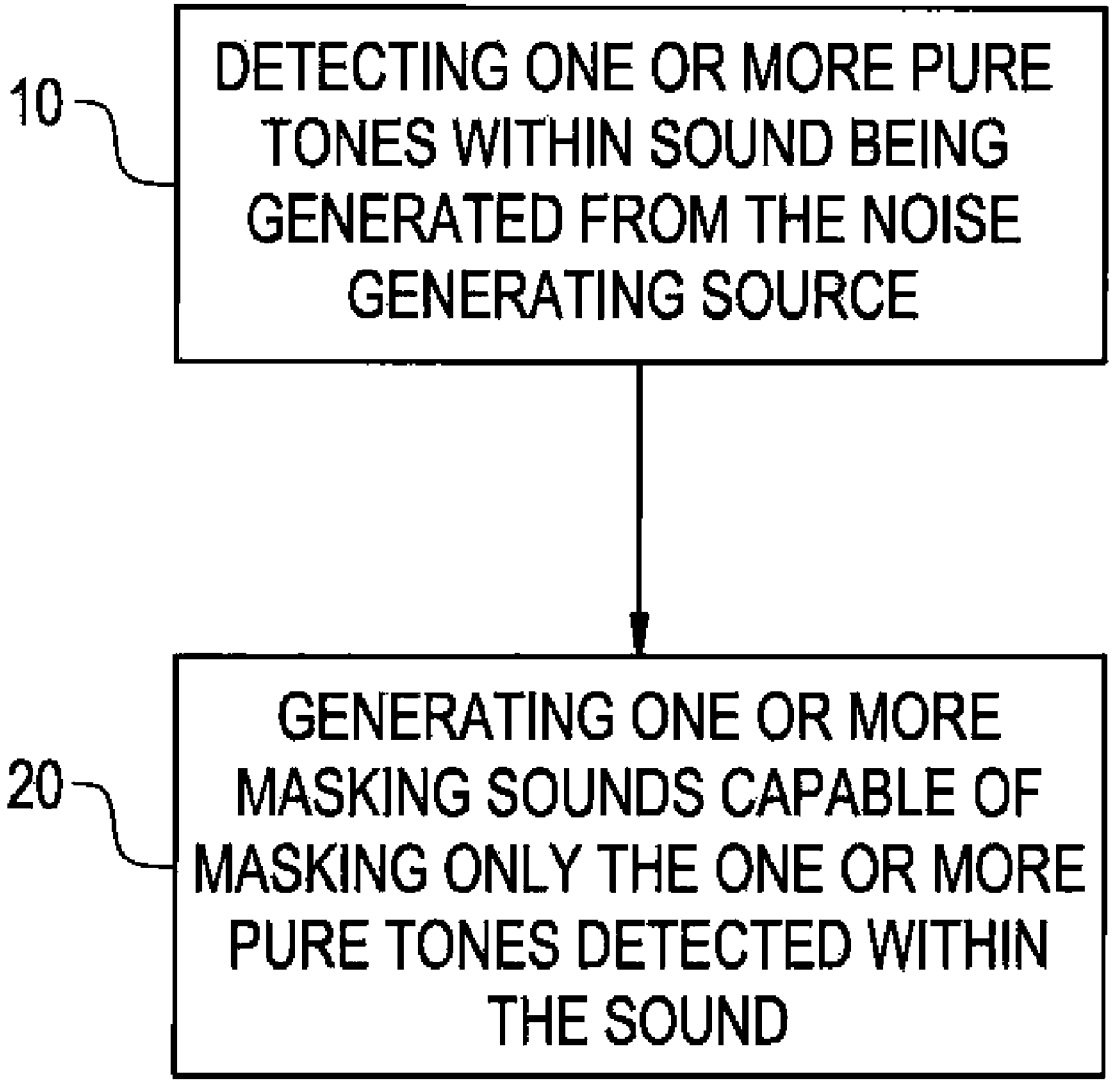
FIG. 1 is a flowchart illustrating a method for masking sound being generated from a noise generating source that can be implemented within embodiments of the present invention.
Figure 2:
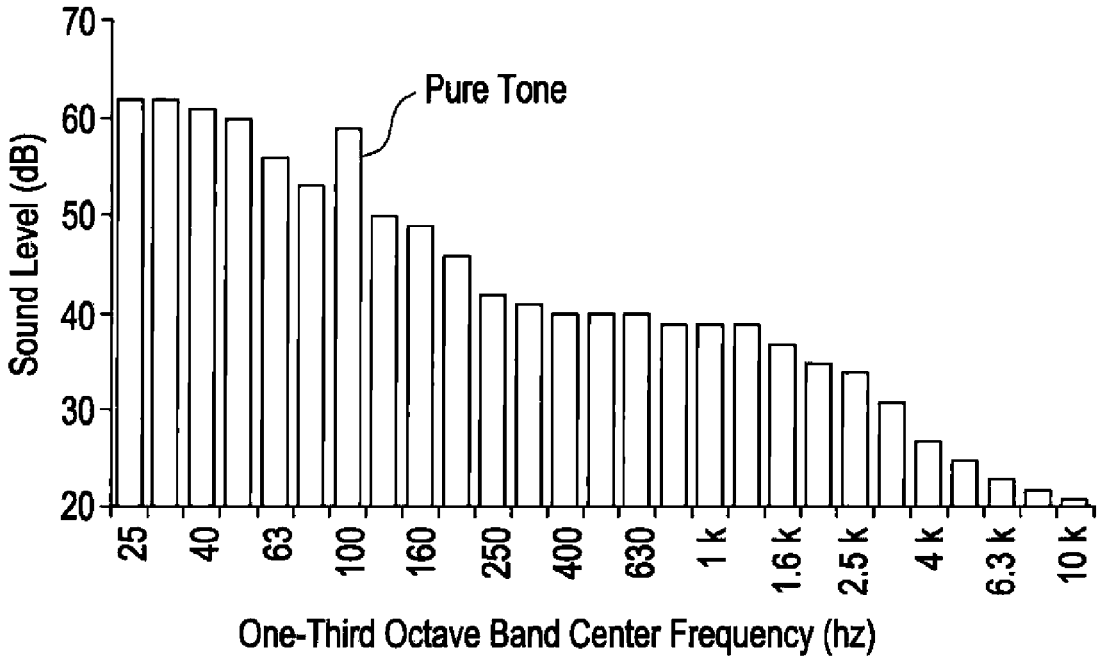
FIG. 2 is a graph illustrating a sound spectrum exhibiting a pure tone according to an embodiment of the present invention.

Turning now to the drawings in greater detail, it will be seen that in FIG. 1, a flowchart is provided illustrating a method for masking pure tones within sound being generated from a noise generating source that can be implemented within embodiments of the present invention. The method shown in FIG. 1 will be described while references FIGS. 2 through 4. In operation 10, one or more pure tones within the sound being generated from a noise generating source are detected. FIG. 2 is a graph illustrating an example of a sound spectrum exhibiting a pure tone according to an embodiment of the present invention. A sound exhibits a pure tone when the sound pressure in a given one-third octave band is at least five decibels above the sound level in each of two adjacent one-third octave bands. As shown in the graph in FIG. 2, a sound spectrum is provided where the sound is broken down into different frequencies. In this example, the one-third octave band at 100 Hz is 58 dB which is at least 5 dB greater than the one-third octave bands at approximately 80 Hz which is 53 dB and approximately 125 Hz which is 50 dB. Therefore, in this example, a pure tone exists at 100 Hz.

Figure 3:
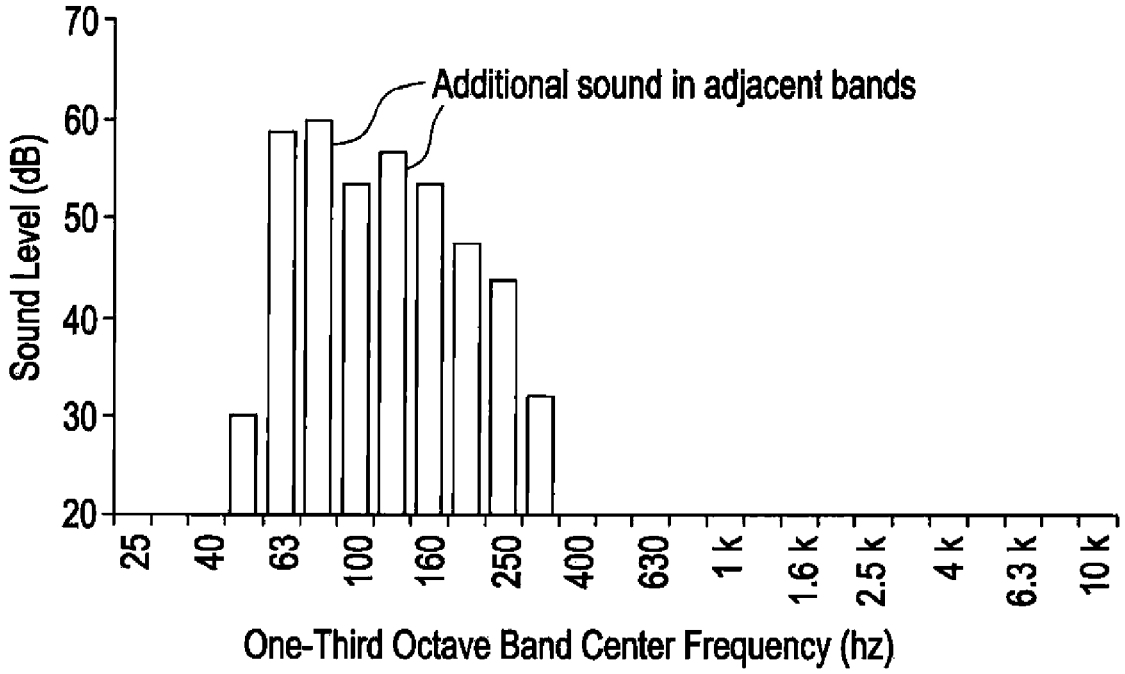
FIG. 3 is graph illustrating a masking spectrum generated for masking the pure tone shown in FIG. 2 that can be implemented within embodiments of the present invention.

When it is determined that pure tones exist, at operation 20, one or more masking sounds are generated capable of masking only the one or more pure tones detected. According to an embodiment of the present invention, the masking sounds are generated based on determining a masking spectrum for masking the pure tones. FIG. 3 illustrates an example of a masking spectrum corresponding to the example of the pure tone shown in FIG. 2 that can be implemented within embodiments of the present invention. In FIG. 3, additional sound is added to adjacent bands based on the location of the band of the pure tone within the sound spectrum. In this example, additional sound is added to the bands at 50 Hz, 63 Hz, 80 Hz, 100 Hz, 125 Hz, 160 Hz, 200 Hz, 250 Hz and 350 Hz. Therefore, the determined masking spectrum includes sound levels only at frequencies selected based on a location of each pure tone. As shown in this example, the sound level at the adjacent bands of the band at 100 Hz is increased in addition to the bands at various other frequencies around the frequency corresponding to the pure tone.

Figure 4:
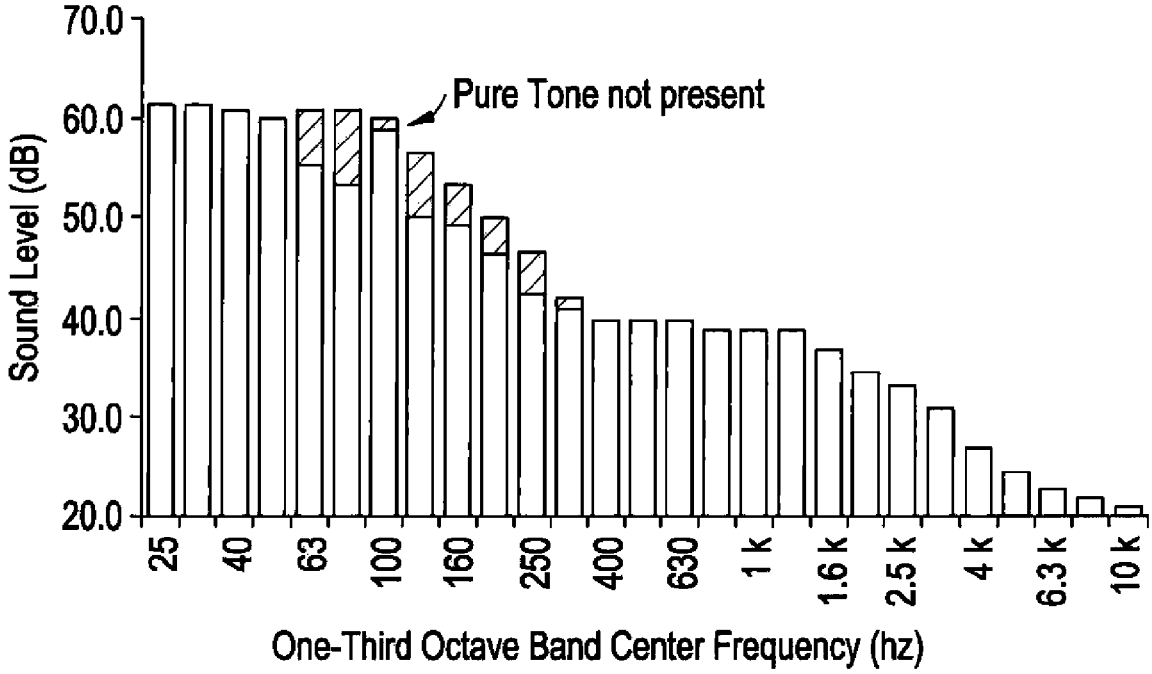
FIG. 4 is a graph illustrating a sound spectrum of having the effect of the masking spectrum shown in FIG. 3 that can be implemented within embodiments of the present invention.

According to an embodiment of the present invention, the masking sound is output in a direction towards a receptor receiving the sound being generated from a noise generating source, to mask the pure tones. FIG. 4 is a graph illustrating a sound spectrum of having the effect of the masking sound generated based on the masking spectrum shown in FIG. 3 that can be implemented within embodiments of the present invention. As shown in FIG. 4, according to an embodiment of the present invention, the measured pure tone at 100 Hz is now eliminated by "filling in" the sound spectrum around the pure tone. Thus, the sound pressure level at the tonal frequency is not reduced but the degree by which is stands out above the adjacent frequencies is reduced, thereby reducing or eliminated the pure tone. That is, the one-third octave band at 100 Hz is no longer 5 dB greater than the adjacent bands, thereby smoothing out the sound from the noise generating source. The method shown in FIG. 1 maybe performed via a sound masking system according to an embodiment of the present invention as shown in FIG. 5, for example.

Figure 5:
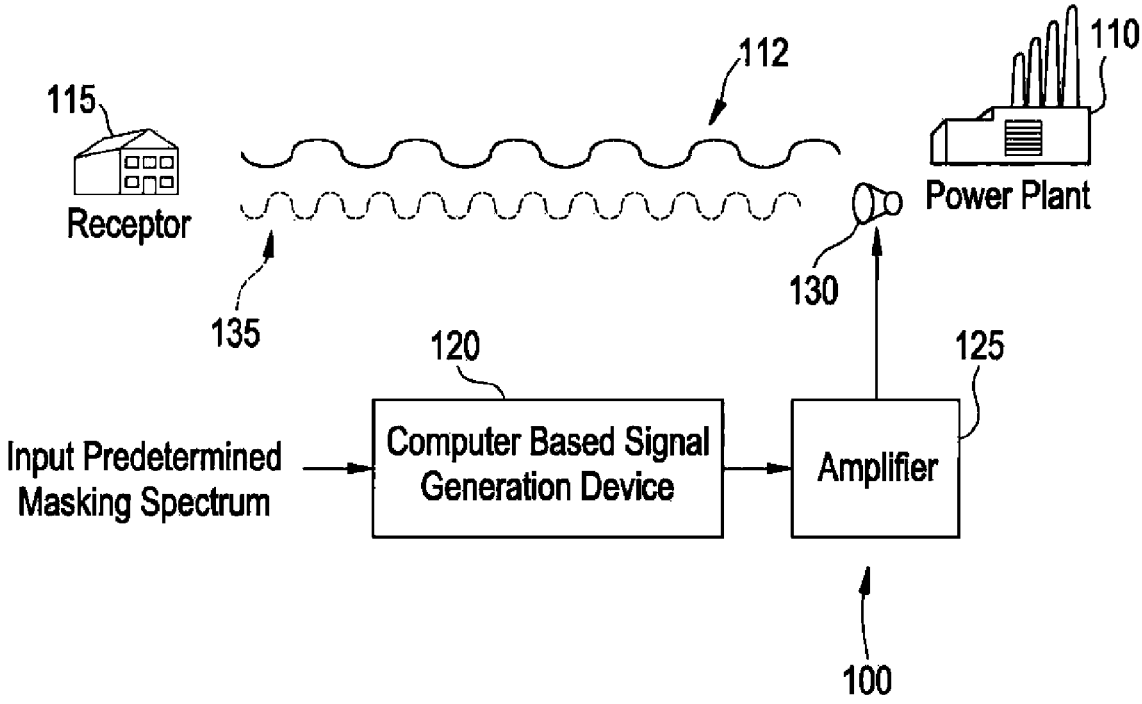
FIG. 5 is a block diagram illustrating a semi-active sound masking system that can be implemented within embodiments of the present invention.

FIG. 5 illustrates a semi-active sound masking system that can be implemented within embodiments of the present invention. The sound masking system according to embodiments of the present invention may be applied to any type of noise generating source such as thermal or nuclear power plants, or wind farms, or any type of power generating equipment or other devices which generate noise. In FIG. 5, a sound masking system 100 according to an embodiment of the present invention is utilized in a power plant environment to eliminate pure tones in sound being generated from the power plant. As shown in FIG. 5, a noise generating source 110 (e.g., a power plant 110) generates power plant sound 112 in a direction towards at least one receptor 115 e.g., a home in an area surrounding the power plant 110. Also, the sound masking system 100 includes a computer-based signal generation device 120, an amplifier 125 and a speaker 130. The present invention is not limited to any particular number of computer-based signal generation devices 120, amplifiers 125 or speakers 130 and may vary according to the number of receptors 115 and/or noise generating sources 110.

The power plant sound 112 generated from the power plant 110 may include pure tones which need to be eliminated. According to an embodiment of the present invention, one or more pure tones are detected within the power plant sound 112 received at the receptor 115. The detection of pure tones is performed manually using a portable sensing device, for example. The output from the portable sensing device, for example, is analyzed to determine a suitable masking spectrum (as shown in FIG. 3, for example) and a volume for generating one or more masking sounds 135 to be applied to the power plant sound 112 in order to mask any pure tones within the power plant sound 112. The selected masking spectrum and volume information are then input into the device 120 such that the system 100 is programmed with the selected masking spectrum and volume information. The device 120 then generates one or more masking sounds 135 at a volume corresponding to the selected masking spectrum, to be directed towards the receptor 115. The generated masking sound 135 is input into the amplifier 125 which amplifies the one or more masking sounds 135 and the masking sounds 135 are then output via the speaker 130 which is operatively connected with the amplifier. The speaker 130 outputs the masking sounds 135 in the same direction as the power plant sound 112 being generated from the power plant 110 to mask the one or more pure tones in the power plant sound 112, however, the present invention is not limited hereto. According to another embodiment of the present invention, the speaker 130 may be arranged "offline" such that the masking sounds 135 are output from a different direction than that of the power plant sound 112 and remain directed towards the receptor 115, to mask the pure tones in the power plant sound 112.

According to the current embodiment of the present invention, in FIG. 5, the sound masking system 100 performs a semi-active method of masking pure tones such that when one or more pure tones are detected within the power plant sound 112, the one or more masking sounds 135 are generated by the device 120 and remain consistent regardless of any variations of the power plant sound 112 until the power plant sound 112 is sensed again by the sensing device. That is, the power plant sound 112 may be sensed at the receptor 115 once or periodically and the one or more masking sounds 135 are therefore adjusted based on the number of times the power plant sound is sensed and in between performing sensing operations, the system 100 continuously outputs the same masking sound 135. An active method of masking pure tones will now be described below with reference to active sound masking systems according to alternative embodiments of the present invention as shown in FIGS. 6 and 7.

Figure 6:
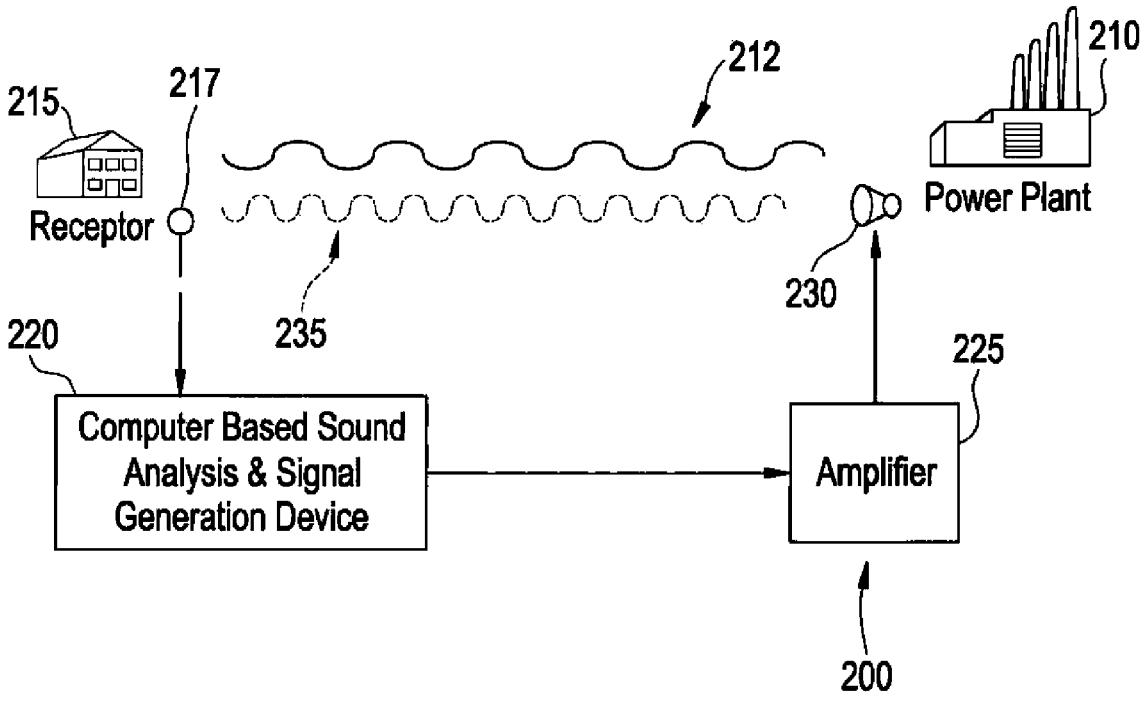
FIG. 6 is a block diagram illustrating an active sound masking system that can be implemented within alternative embodiments of the present invention.
Figure 7:
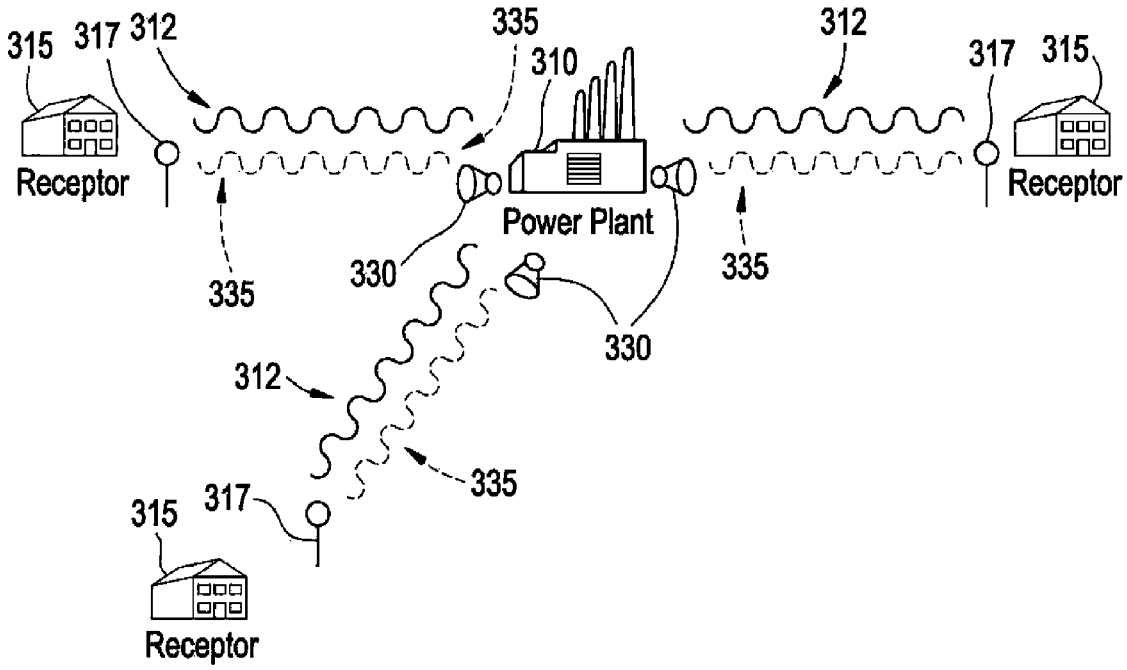
FIG. 7 is a block diagram illustrating an active sound masking system that can be implemented within alternative embodiments of the present invention.

FIG. 6 is a block diagram illustrating an active sound masking system 200 that can be implemented within alternative embodiments of the present invention. As shown in FIG. 6, a power plant 210 generates power plant sound 212 towards a receptor 215. A sound masking system 200 is provided and includes a sensing device (i.e., a sensor 217), a computer-based sound analysis and signal generation device 220, an amplifier 225 and a speaker 230. In the current embodiment of the present invention, the sound masking system 200 performs an active method of masking pure tones. The sensor 217 may be permanently mounted at the receptor 215, for example, however the present invention is not limited hereto. Alternatively, the sensor 217 may be mounted adjacent to the noise generating source which is in this case, the power plant 210. According to an embodiment of the present invention, the sensor 217 may be a microphone or any other suitable sensing device. The sensor 217 senses the power plant sound 212 being generated from the power plant 210 and received at the receptor 215.

The device 220 receives feedback from the sensor 217 and detects one or more pure tones within the power plant sound 212. When it is determined that pure tones are present, a suitable masking spectrum and a volume thereof are determined by the device 220 for the location of the respective receptor 215. The masking spectrum includes increased sound levels at frequencies around the frequency corresponding to each pure tone. The device 220 then generates one or more masking sounds 235 at the volume corresponding to the determined masking spectrum. The amplifier 225 which is connected to the device 220 receives the one or more masking sounds 235 from the device 220 and amplifies the one or more masking sounds 235. The speaker 230 which is operatively connected with the amplifier 225, outputs the one or more masking sounds 235 at the predetermined volume in the same direction as the power plant sound 212 generated from the power plant 210.

According to an embodiment of the present invention, the sensor 217 continuously senses the power plant sound 212 being generated from the power plant 210 at a location of the respective receptor 215 around the power plant 210 and the one or more masking sounds 235 (as depicted in the graph in FIG. 4, for example) and provides feedback to the device 220 and the device 220 automatically varies the one or more masking sounds 235 and the volume as the power plant sound 212 being generated from the power plant 210 varies. Since the device 220 generates the one or more masking sounds 235, it is able to determine the adjustments to the masking sound 235 as needed based on the feedback received from the sensor 217. Thus, in this embodiment of the present invention, the masking sound 235 is continuously adjusted in both the spectral content and the volume based on changes in the power plant sound 212 as well as changes in conditions and sound at the receptor 215. Thus, if the power plant 210 generates sound which varies, the masking sound 235 is automatically adjusted to correspond to the generated sound. For example, if more pure tones are generated from the power plant during high-power operation than during low-power operation or vice versa, the masking sound 235 is adjusted accordingly. According to an embodiment of the present invention, if the device 220 determines that no pure tones exist in the power plant sound 210, the device 220 will not generate a masking spectrum or corresponding masking sound 235. That is, the device only generates the masking spectrum and masking sound 235 when it determines that pure tones exist.

According to an embodiment of the present invention, as mentioned above, the sound masking system is not limited to any particular number of sensors, signal generation devices, amplifiers and speakers, and may vary as necessary. FIG. 7 illustrates a sound masking system 300 that can be implemented within alternative embodiments of the present invention. As shown in FIG. 7, a power plant 310 generates power plant sound 312 towards multiple receptors 315. The sound masking system 300 includes a plurality of sensors 317 corresponding to the number of receptors 315, and positioned at different locations around the power plant 310. Each sensor 317 senses the power plant sound 312 received from the power plant 310 at each respective location. According to an embodiment of the present invention, the sound masking system 300 may further include one or more signal generating devices which receive feedback from the sensors 317, detects one or more pure tones within the power plant sound 312 and generates one or more masking sounds 335 capable of masking the one or more pure tones within the power plant sound 312 received from the power plant 310 at each respective receptor 315 when one or more pure tones exist within the power plant sound 312 received. A plurality of speakers 330 are provided around the power plant 310 to output the one or more masking sounds 335 in the same direction as the power plant sound 312 toward the respective receptors 315. According to an embodiment of the present invention, since the power plant sound 312 may vary based on the location of each receptor 315, the one or more masking sounds 335 is also varied by the one or more signal generation devices to correspond to the power plant sound 312 received at each receptor 315.

The sound masking system of the present invention may be used for eliminating pure tones in any noise where a modest increase in the overall noise is acceptable but measured tonal noise is unacceptable.

Embodiments of the present invention provide methods and sound masking systems for determining whether pure tones exist in sound generated from a noise generating source, and masking pure tones within sound, thereby reducing the unwanted noise and reducing maintenance costs associated with eliminated unwanted noise generating by these noise generating sources.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for masking pure tones within sound generated from a noise generating source, the method comprising:

detecting one or more pure tones within sound being generated from the noise generating source; and generating a masking spectrum that includes sound levels at frequencies in bands that are adjacent to each of the one or more pure tones within the sound wherein the sound levels are at frequencies selected based on respective locations of each of the one or more pure tones.

2. The method of claim 1, wherein generating one or more masking sounds comprises determining a masking spectrum having increased sound levels only at frequencies selected based on a location of each pure tone.

3. The method of claim 2, further comprising:

sensing continuously the sound being generated from the noise generating source and the generated masking sound;

detecting any changes in the sound being generated from the noise generating source when sensing continuously; and automatically varying the masking spectrum and generating one or more masking sounds based on the varied masking spectrum according to the detected changes.

4. A sound masking system for masking pure tones within sound being generated from a noise generating source, the system comprising:

a signal generation device which receives a selected masking spectrum when one or more pure tones are detected, and generates one or more masking sounds at a volume corresponding to the selected masking spectrum;

at least one amplifier which amplifies the one or more masking sounds; and at least one speaker operatively connected with the at least one amplifier, which outputs the one or more masking sounds to mask the one or more pure tones detected.

5. The sound masking system of claim 4, wherein the signal generation device varies the masking sound as the selected masking spectrum input into the signal generation device is varied.

6. A sound masking system for masking pure tones within sound being generated from a noise generating source, the system comprising:

at least one sensing device which senses the sound being generated from the noise generating source;

at least one signal generation device which receives feedback from the at least one sensing device, detects one or more pure tones within the sound being generated from the noise generating source and generates a masking spectrum that includes sound levels at frequencies in bands that are adjacent to each of the one or more pure tones within the sound, wherein the sounds levels are at frequencies selected based on respective locations of each of the one or more pure tones;

at least one amplifier which amplifies the one or more masking sounds; and at least one speaker operatively connected with the at least one amplifier, which outputs the one or more masking sounds to mask the one or more pure tones detected.

7. The sound masking system of claim 6, wherein the at least one sensing device is a microphone.

8. The sound masking system of claim 6, wherein the at least one signal generation device determines a masking spectrum including increased sound levels only at frequencies selected based on a location of each pure tone and generates the one or more masking sounds corresponding to the masking spectrum determined.

9. The sound masking system of claim 8, wherein the at least one sensing device continuously senses the sound being generated from the noise generating source and the one or more masking sounds, and continuously provides feedback to the at least one signal generation device, and the at least one signal generation device automatically varies the one or more masking sounds and volume thereof as the sound being generated from the noise generating source varies.

10. The sound masking system of claim 9, further comprising:

a plurality of sensing devices positioned at different locations around the noise generating source, wherein each sensing device senses sound received from the noise generating source at each respective location and the at least one signal generation device receives feedback from the sensing devices, detects one or more pure tones within the sound and generates one or more masking sounds capable of masking the one or more pure tones within the sound received from the noise generating source at each respective location; and a plurality of speakers which output the one or more masking sounds toward each respective location.

* * * * *